US010339874B2

(12) United States Patent
Won et al.

(10) Patent No.: US 10,339,874 B2
(45) Date of Patent: Jul. 2, 2019

(54) DISPLAY APPARATUS AND METHOD OF DRIVING DISPLAY PANEL USING THE SAME

(71) Applicant: Samsung Display Co., Ltd., Yongin-Si, Gyeonggi-Do (KR)

(72) Inventors: Hyeonuk Won, Suwon-si (KR); Jang-Mi Lee, Busan (KR); Wonjin Seo, Seoul (KR); Hyun-Sik Yoon, Asan-si (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 0 days.

(21) Appl. No.: 15/714,020

(22) Filed: Sep. 25, 2017

(65) Prior Publication Data

US 2018/0151127 A1 May 31, 2018

(30) Foreign Application Priority Data

Nov. 30, 2016 (KR) ..... 10-2016-0162104

(51) Int. Cl.

*G09G 3/36* (2006.01)
*G09G 3/3258* (2016.01)
*G09G 3/3275* (2016.01)

(52) U.S. Cl.

CPC ..... *G09G 3/3275* (2013.01); *G09G 3/3258* (2013.01); *G09G 3/3659* (2013.01); *G09G 3/3688* (2013.01); *G09G 2300/0439* (2013.01); *G09G 2310/08* (2013.01); *G09G 2320/041* (2013.01); *G09G 2340/16* (2013.01); *G09G 2360/16* (2013.01)

(58) Field of Classification Search

CPC ..... G09G 2300/0439; G09G 2310/08; G09G 3/3258; G09G 3/3275; G09G 3/3659; G09G 3/3688; G09G 2320/041; G09G 2340/16; G09G 2360/16

See application file for complete search history.

(56) References Cited

U.S. PATENT DOCUMENTS 3,831,165 A * 8/1974 Chivian ..... B23K 26/18 345/214
6,643,346 B1 * 11/2003 Pedrotti ..... H03L 7/087 331/10
6,785,622 B2 * 8/2004 Nygaard, Jr. ..... H04L 1/24 702/57
7,006,026 B2 * 2/2006 Jo ..... G09G 3/3275 341/135
7,038,654 B2 * 5/2006 Naiki ..... G09G 3/3696 345/101

(Continued)

FOREIGN PATENT DOCUMENTS

KR 100861921 B1 10/2008
KR 1020090091960 A 8/2009
KR 1020140102391 A 8/2014

*Primary Examiner* — Michael J Jansen, II
(74) *Attorney, Agent, or Firm* — Cantor Colburn LLP

(57) ABSTRACT

A display apparatus includes a display panel, a gate driver, a data driver and a timing controller. The display panel displays an image. The gate driver outputs a gate signal to the display panel. The data driver includes a plurality of data driving chips which outputs data voltages to the display panel based on data signals. The timing controller adjusts a waveform of the data signals based on a temperature of the data driving chips.

17 Claims, 6 Drawing Sheets

(56) References Cited

U.S. PATENT DOCUMENTS 8,441,426 B2 * 5/2013 Chung ..... G09G 3/3611 345/204
8,645,585 B2 * 2/2014 Wyatt ..... G09G 5/006 710/10
8,791,884 B2 * 7/2014 Kim ..... G09G 3/3225 315/169.3
8,907,991 B2 * 12/2014 Jaffari ..... G06F 17/5018 345/690
9,196,183 B2 * 11/2015 Hwang ..... G09G 3/00
9,240,142 B2 * 1/2016 Oh ..... G09G 3/3266
9,293,075 B2 * 3/2016 Han ..... G09G 3/006
9,595,217 B2 * 3/2017 Han ..... G09G 3/20
9,633,595 B2 * 4/2017 Hwang ..... G09G 3/2092
9,690,306 B2 * 6/2017 Kimbrell ..... G09G 5/006
9,711,088 B2 * 7/2017 Na ..... G09G 3/3266
9,711,103 B2 * 7/2017 Lee ..... G09G 3/3611
9,959,810 B2 * 5/2018 Kim ..... G09G 3/3233
2001/0045926 A1 * 11/2001 Oowaki ..... G09G 3/3648 345/87
2003/0083833 A1 * 5/2003 Nygaard, Jr. ..... H04L 1/24 702/67
2004/0041762 A1 * 3/2004 Naiki ..... G09G 3/3696 345/87
2005/0030214 A1 * 2/2005 Jo ..... G09G 3/3275 341/145
2006/0031031 A1 * 2/2006 Cohn ..... G01R 13/0254 702/66
2009/0147032 A1 * 6/2009 Kim ..... G09G 3/3225 345/690
2010/0207930 A1 * 8/2010 Chung ..... G09G 3/3611 345/214
2011/0096099 A1 * 4/2011 Yamamoto ..... G09G 3/3426 345/690
2012/0139955 A1 * 6/2012 Jaffari ..... G06F 17/5018 345/690
2012/0317607 A1 * 12/2012 Wyatt ..... G09G 5/006 725/127
2014/0104259 A1 * 4/2014 Oh ..... G09G 3/3266 345/212
2014/0226025 A1 * 8/2014 Han ..... G09G 3/006 348/177
2015/0002488 A1 * 1/2015 Hwang ..... G09G 3/00 345/204
2015/0127187 A1 * 5/2015 Kimbrell ..... G09G 5/006 700/299
2015/0161929 A1 * 6/2015 Han ..... G09G 3/20 345/55
2015/0302822 A1 * 10/2015 Lee ..... G09G 3/2096 345/204
2016/0042691 A1 * 2/2016 Na ..... G09G 3/3266 345/205
2016/0086540 A1 * 3/2016 Kim ..... G09G 3/3233 345/214
2016/0104450 A1 * 4/2016 Lee ..... G09G 3/3611 345/211
2016/0155384 A1 * 6/2016 Kim ..... G09G 3/3258 345/212
2016/0203753 A1 * 7/2016 Hwang ..... G09G 3/2092 345/212
2016/0343342 A1 * 11/2016 Kim ..... G09G 3/20
2017/0309241 A1 * 10/2017 Shin ..... G09G 3/3677
2018/0061299 A1 * 3/2018 Jung ..... G06F 3/0412
2018/0151127 A1 * 5/2018 Won ..... G09G 3/3275

* cited by examiner

620

| TEMP | CMP |
|---|---|
| TEMPA | CMPA |
| TEMPB | CMPB |
| TEMPC | CMPC |
| TEMPD | CMPD |
| ⋮ | ⋮ |
| TEMPN | CMPN |

620A

| TEMP | CMP1 | CMP2 |
|---|---|---|
| TEMPA | CMP1A | CMP2A |
| TEMPB | CMP1B | CMP2B |
| TEMPC | CMP1C | CMP2C |
| TEMPD | CMP1D | CMP2D |
| ⋮ | ⋮ | ⋮ |
| TEMPN | CMP1N | CMP2N |

DISPLAY APPARATUS AND METHOD OF DRIVING DISPLAY PANEL USING THE SAME

This application claims priority to Korean Patent Application No. 10-2016-0162104, filed on Nov. 30, 2016, and all the benefits accruing therefrom under 35 U.S.C. § 119, the content of which in its entirety is herein incorporated by reference.

BACKGROUND

1. Field

Exemplary embodiments of the invention relate to a display apparatus and a method of driving a display panel using the display apparatus. More particularly, exemplary embodiments of the invention relate to a display apparatus that adjusts a waveform of a data signal according to a temperature of a data driving chip to improve a display quality of a display panel and a method of driving a display panel using the display apparatus.

2. Description of the Related Art

Generally, a display apparatus includes a display panel and a display panel driver. The display panel typically includes a plurality of gate lines, a plurality of data lines and a plurality of pixels. The display panel driver typically includes a gate driver providing gate signals to the gate lines, a data driver providing data voltages to the data lines and a timing controller outputting a gate control signal to the gate driver and a data control signal and a data signal to the data driver.

The data signal transmitted from the timing controller to the data driver may have noise according to a structure of the display panel driver, a structure of the data driver, a resistance of a signal transmitting wiring and so on.

SUMMARY

Exemplary embodiments of the invention provide a display apparatus that adjusts a waveform of a data signal based on a temperature of a data driver to compensate a noise of the data signal and to thereby improve a display quality of a display panel.

Exemplary embodiments of the invention also provide a method of driving a display panel using the above-mentioned display apparatus.

In an exemplary embodiment of a display apparatus according to the invention, the display apparatus includes a display panel, a gate driver, a data driver and a timing controller. In such an embodiment, the display panel displays an image. In such an embodiment, the gate driver outputs a gate signal to the display panel. In such an embodiment, the data driver includes a plurality of data driving chips which outputs data voltages to the display panel based on data signals. In such an embodiment, the timing controller adjusts a waveform of the data signals based on a temperature of the data driving chips.

In an exemplary embodiment, the timing controller may adjust an eye-diagram waveform of the data signals in a way such that the eye-diagram waveform of the data signals does not meet a mask representing a noise limit of the data signal.

In an exemplary embodiment, the timing controller may include an eye-diagram compensating part which receives a temperature signal representing the temperature of the data driving chips and determines an eye-diagram compensating value corresponding to the temperature of the data driving chips, and an image compensating part which adjusts the waveform of the data signals based on the eye-diagram compensating value.

In an exemplary embodiment, the display apparatus may further include a memory which stores the eye-diagram compensating values corresponding to the temperature of the data driving chips. In such an embodiment, the memory may be disposed outside of the timing controller.

In an exemplary embodiment, the timing controller may increase an amplitude of the data signals based on the eye-diagram compensating value corresponding to the temperature of the data driving chips so that a vertical width of the eye-diagram waveform is increased.

In an exemplary embodiment, the image compensating part of the timing controller may determine an overshooting value to change grayscale data of present frame data signal using previous frame data signal and the present frame data signal.

In an exemplary embodiment, the timing controller may increase the overshooting value of the data signal based on the eye-diagram compensating value corresponding to the temperature of the data driving chips so that an inclination of a diagonal waveform of the eye-diagram waveform is increased.

In an exemplary embodiment, the timing controller may further include a signal generating part which generates a first control signal to control a driving timing of the gate driver based on an input control signal, and a second control signal to control a driving timing of the data driver based on the input control signal.

In an exemplary embodiment, the timing controller may decrease a frame rate of the data signals based on the eye-diagram compensating value corresponding to the temperature of the data driving chips so that a horizontal width of the eye-diagram waveform is increased.

In an exemplary embodiment, the eye-diagram compensating part may determine an eye-diagram level compensating value corresponding to the temperature of the data driving chips and an eye-diagram timing compensating value corresponding to the temperature of the data driving chips based on the temperature signal. In such an embodiment, the eye-diagram level compensating value may determine at least one of an amplitude of the data signal and an overshooting value of the data signal. In such an embodiment, the eye-diagram timing compensating value may determine the frame rate of the data signals. In such an embodiment, the image compensating part may compensates the data signals based on input image data, the eye-diagram level compensating value and the eye-diagram timing compensating value. In such an embodiment, the signal generating part may generate the first control signal and the second control signal based on the input control signal, the eye-diagram level compensating value and the eye-diagram timing compensating value.

In an exemplary embodiment of a method of driving a display panel of a display apparatus according to the invention, the method includes adjusting a waveform of data signals to be outputted from data driving chips based on a temperature of the data driving chips of the display apparatus using a timing controller, outputting data voltages to a display panel of the display apparatus based on the data signals, outputting gate signals to the display panel, and displaying an image using the display panel based on the gate signals and the data voltages.

In an exemplary embodiment, the adjusting the waveform of the data signals may include adjusting an eye-diagram waveform of the data signals in a way such that the eye-diagram waveform of the data signals does not meet a mask representing a noise limit of the data signal.

In an exemplary embodiment, the timing controller may include an eye-diagram compensating part which receives a temperature signal representing the temperature of the data driving chips and determines an eye-diagram compensating value corresponding to the temperature of the data driving chips based on the temperature signal, and an image compensating part which adjusts the waveform of the data signals based on the eye-diagram compensating value.

In an exemplary embodiment, the adjusting the waveform of the data signals may include increasing an amplitude of the data signals based on the eye-diagram compensating value corresponding to the temperature of the data driving chips so that a vertical width of the eye-diagram waveform is increased.

In an exemplary embodiment, the image compensating part of the timing controller may determine an overshooting value to change grayscale data of present frame data signal using previous frame data signal and the present frame data signal.

In an exemplary embodiment, the adjusting the waveform of the data signals may include increasing the overshooting value of the data signals based on the eye-diagram compensating value corresponding to the temperature of the data driving chips so that an inclination of a diagonal waveform of the eye-diagram waveform is increased.

In an exemplary embodiment, the timing controller may further include a signal generating part which generates a first control signal to control a driving timing of the gate driver based on an input control signal, and a second control signal to control a driving timing of the data driver based on the input control signal.

In an exemplary embodiment, the adjusting the waveform of the data signals may further include decreasing a frame rate of the data signals based on the eye-diagram compensating value corresponding to the temperature of the data driving chips so that a horizontal width of the eye-diagram waveform is increased.

In an exemplary embodiment, the eye-diagram compensating part may determine an eye-diagram level compensating value corresponding to the temperature of the data driving chips and an eye-diagram timing compensating values corresponding to the temperature of the data driving chips, based on the temperature signal. In such an embodiment, the eye-diagram level compensating values may determine at least one of an amplitude of the data signal and an overshooting value of the data signal. In such an embodiment, the eye-diagram timing compensating values may determine the frame rate of the data signals. In such an embodiment, the image compensating part may compensate the data signal based on input image data, the eye-diagram level compensating value and the eye-diagram timing compensating value. In such an embodiment, the signal generating part may generate the first control signal and the second control signal based on the input control signal, the eye-diagram level compensating value and the eye-diagram timing compensating value.

According exemplary embodiments of to the display apparatus and the method of driving the display panel using the display apparatus, the eye-diagram waveform of the data signal is adjusted according to the temperature of the data driving chip such that the noise of the data signal both in an ordinary temperature and in a high temperature may be effectively compensated. Thus, in such embodiments, the display quality of the display panel may be improved.

BRIEF DESCRIPTION OF THE DRAWINGS

The above and other features of the invention will become more apparent by describing in detailed exemplary embodiments thereof with reference to the accompanying drawings, in which.

DETAILED DESCRIPTION

Figure 1:
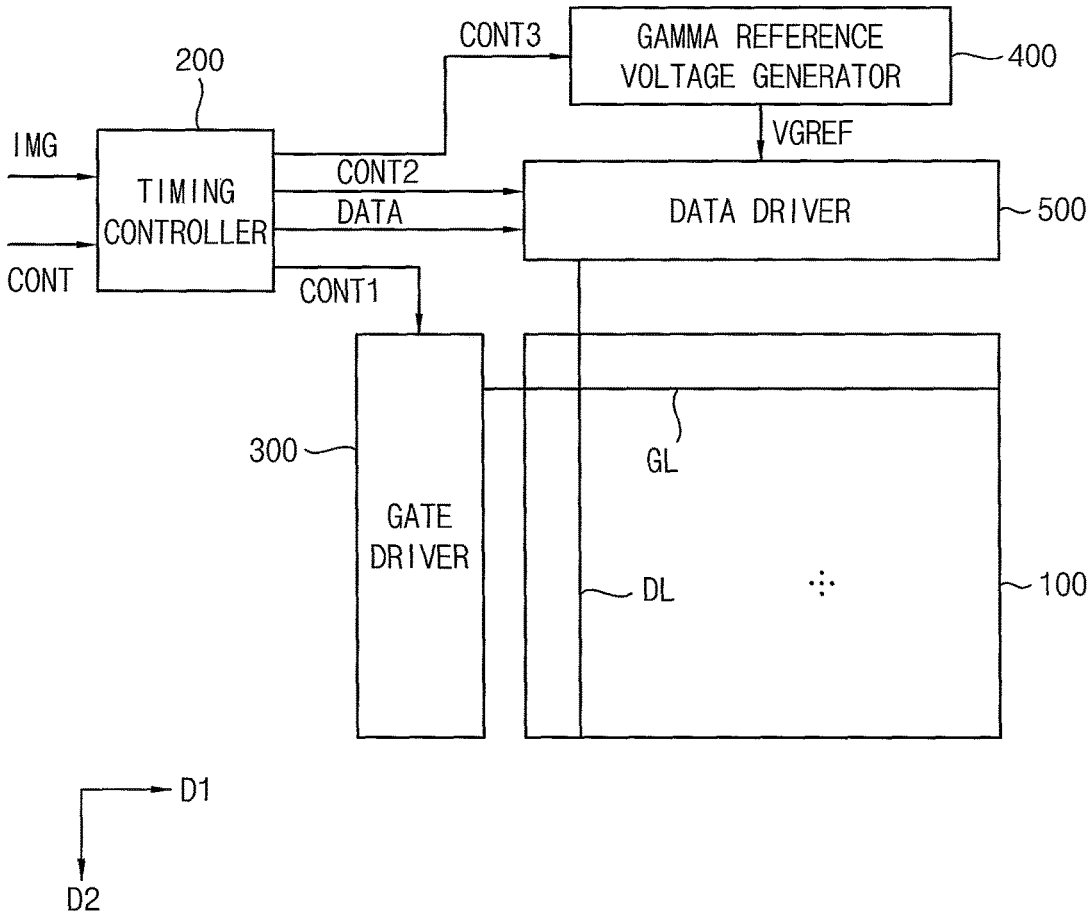
FIG. 1 is a block diagram illustrating a display apparatus according to an exemplary embodiment of the invention.

The invention now will be described more fully hereinafter with reference to the accompanying drawings, in which various embodiments are shown. This invention may, however, be embodied in many different forms, and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that when an element is referred to as being "on" another element, it can be directly on the other element or intervening elements may be therebetween. In contrast, when an element is referred to as being "directly on" another element, there are no intervening elements present.

It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein The terminology used herein is for the purpose of describing particular embodiments only and is not intended to be limiting. As used herein, the singular forms "a," "an," and "the" are intended to include the plural forms, including "at least one," unless the content clearly indicates otherwise. "Or" means "and/or." As used herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower," can therefore, encompasses both an orientation of "lower" and "upper," depending on the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and the disclosure, and will not be interpreted in an idealized or overly formal sense unless expressly so defined herein Exemplary embodiments are described herein with reference to cross section illustrations that are schematic illustrations of idealized embodiments. As such, variations from the shapes of the illustrations as a result, for example, of manufacturing techniques and/or tolerances, are to be expected. Thus, embodiments described herein should not be construed as limited to the particular shapes of regions as illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the claims.

Hereinafter, exemplary embodiments of the invention will be described in detail with reference to the accompanying drawings.

FIG. 1 is a block diagram illustrating a display apparatus according to an exemplary embodiment of the invention.

Referring to FIG. 1, an exemplary embodiment of the display apparatus includes a display panel 100 and a display panel driver. The display panel driver includes a timing controller 200, a gate driver 300, a gamma reference voltage generator 400 and a data driver 500.

The display panel 100 has a display region on which an image is displayed and a peripheral region adjacent to the display region.

The display panel 100 includes a plurality of gate lines GL, a plurality of data lines DL and a plurality of pixels connected to the gate lines GL and the data lines DL. The gate lines GL extend in a first direction D1 and the data lines DL extend in a second direction D2 crossing the first direction D1.

Each pixel includes a switching element (not shown), a liquid crystal capacitor (not shown) and a storage capacitor (not shown). The liquid crystal capacitor and the storage capacitor are electrically connected to the switching element. The pixels may be disposed in a matrix form.

The timing controller 200 receives input image data IMG and an input control signal CONT from an external apparatus (not shown). The input image data may include red image data, green image data and blue image data. The input control signal CONT may include a master clock signal and a data enable signal. The input control signal CONT may further include a vertical synchronizing signal and a horizontal synchronizing signal.

The timing controller 200 generates a first control signal CONT1, a second control signal CONT2, a third control signal CONT3 and a data signal DATA based on the input image data IMG and the input control signal CONT.

The timing controller 200 generates the first control signal CONT1 for controlling an operation of the gate driver 300 based on the input control signal CONT, and outputs the first control signal CONT1 to the gate driver 300. The first control signal CONT1 may further include a vertical start signal and a gate clock signal.

The timing controller 200 generates the second control signal CONT2 for controlling an operation of the data driver 500 based on the input control signal CONT, and outputs the second control signal CONT2 to the data driver 500. The second control signal CONT2 may include a horizontal start signal and a load signal.

The timing controller 200 generates the data signal DATA based on the input image data IMG The timing controller 200 outputs the data signal DATA to the data driver 500.

The timing controller 200 generates the third control signal CONT3 for controlling an operation of the gamma reference voltage generator 400 based on the input control signal CONT, and outputs the third control signal CONT3 to the gamma reference voltage generator 400.

The timing controller 200 adjusts waveforms of the data signals to be outputted to the data driving chips according to temperatures of the data driving chips.

The structure and the operation of the timing controller 200 will be described later in greater detail referring to FIGS. 3 to 7.

The gate driver 300 generates gate signals driving the gate lines GL in response to the first control signal CONT1 received from the timing controller 200. The gate driver 300 sequentially outputs the gate signals to the gate lines GL.

The gamma reference voltage generator 400 generates a gamma reference voltage VGREF in response to the third control signal CONT3 received from the timing controller 200. The gamma reference voltage generator 400 provides the gamma reference voltage VGREF to the data driver 500. The gamma reference voltage VGREF has a value corresponding to a level of the data signal DATA.

In an exemplary embodiment, the gamma reference voltage generator 400 may be disposed in the timing controller 200, or in the data driver 500.

The data driver 500 receives the second control signal CONT2 and the data signal DATA from the timing controller 200, and receives the gamma reference voltages VGREF from the gamma reference voltage generator 400. The data driver 500 converts the data signal DATA into data voltages of an analog type using the gamma reference voltages VGREF. The data driver 500 outputs the data voltages to the data lines DL.

Figure 2:
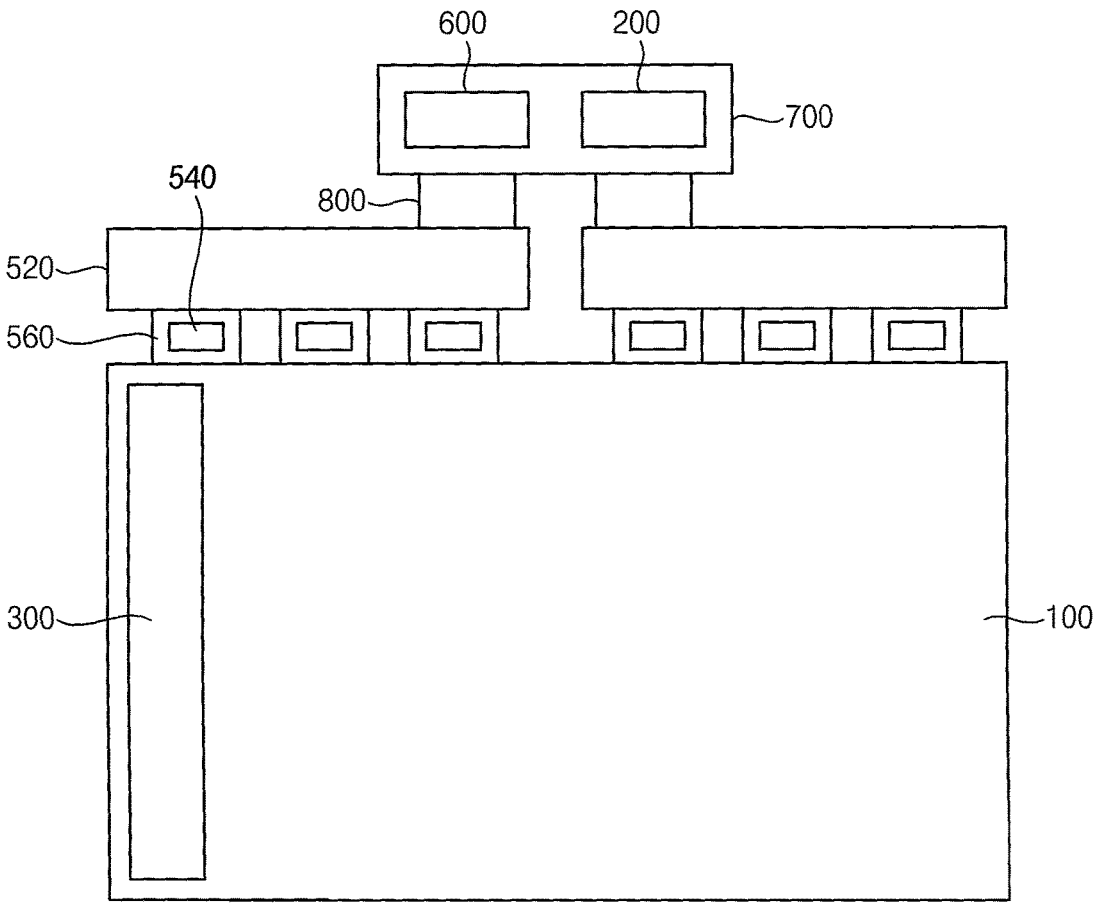
FIG. 2 is a plan view illustrating the display apparatus of FIG. 1.

FIG. 2 is a plan view illustrating the display apparatus of FIG. 1.

Referring to FIGS. 1 and 2, an exemplary embodiment of the display apparatus may further include a memory 600 independently formed from (or disposed outside of) the timing controller 200, and a main printed circuit board 700 on which the timing controller 200 and the memory 600 are disposed, e.g., mounted. In one exemplary embodiment, for example, the memory 600 may be an electrically erasable programmable read-only memory ("EEPROM"). The memory 600 may be in the form of an integrated circuit ("IC").

The data driver 500 may include a plurality of data driving chips 540. The data driving chips 540 may be disposed on a data connecting circuit board 560. The data driving chips 540 may be connected to each other by a sub printed circuit board 520. The data connecting circuit board 560 connects the sub printed circuit board 520 to the display panel 100.

The display apparatus may further include a main connecting circuit board 800 which connects the main printed circuit board 700 to the sub printed circuit board 520.

In such an embodiment, as the size of the display panel 100 increases, the sizes of the main printed circuit board 700 or the main connecting circuit board 800 may increase. In such an embodiment, as the size of the display panel 100 increases, the lengths of signal wirings between the timing controller 200 and the data driver 500 may increase.

When the size of the main printed circuit board 700 or the size of the main connecting circuit board 800 increases or the length of signal wirings between the timing controller 200 and the data driver 500 increases, a noise of the data signal DATA transmitted from the timing controller 200 to the data driver 500 may increase.

In an exemplary embodiment, the gate driver 300 may be integrated on the display panel 100. Alternatively, the gate driver 300 may be disposed on the display panel 100.

Figure 3:
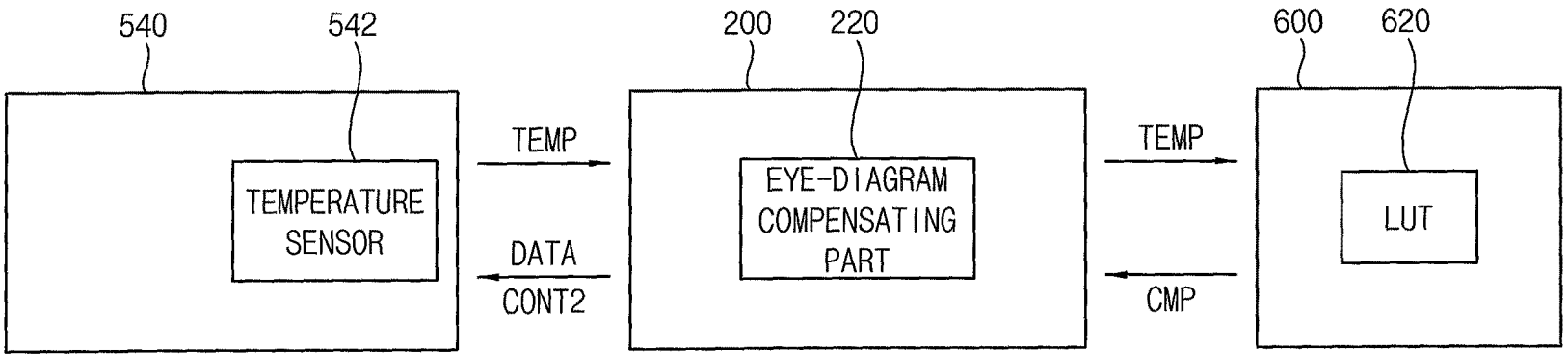
FIG. 3 is a block diagram illustrating operations of a data driving chip of FIG. 1, a timing controller of FIG. 1 and a memory of FIG. 2.
Figures 4, 5:
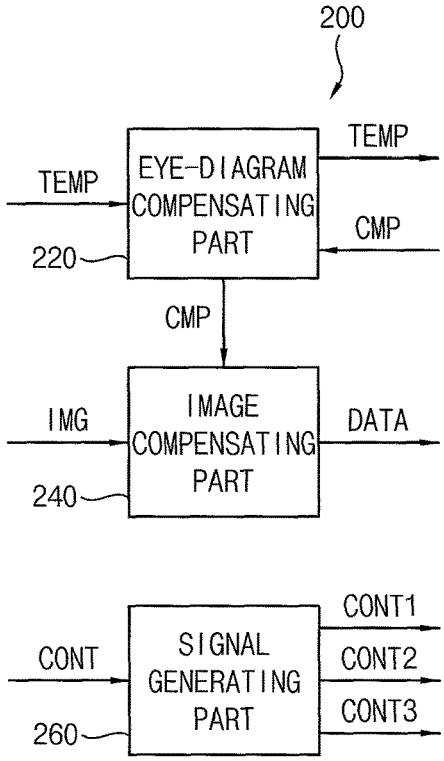
FIG. 4 is a block diagram illustrating the timing controller of FIG. 1.
FIG. 5 is a diagram illustrating a lookup table stored in the memory of FIG. 2.

FIG. 3 is a block diagram illustrating operations of the data driving chip 540 of FIG. 1, the timing controller 200 of FIG. 1 and the memory 600 of FIG. 2. FIG. 4 is a block diagram illustrating the timing controller 200 of FIG. 1. FIG. 5 is a diagram illustrating a lookup stored in the memory 600 of FIG. 2.

Referring to FIGS. 1 to 5, the data driving chip 540 may include a temperature sensor 542 which senses a temperature of the data driving chip 540. The data driver 500 includes the plurality of the data driving chips 540. In an exemplary embodiment, the temperature sensor 542 may be disposed in each of the data driving chips 540. In such an embodiment, the temperature sensor 542 may be provided in plural, that is, the data driver 500 may include a plurality of temperature sensors 542.

The temperature sensor 542 output a temperature signal TEMP representing the temperature of the data driving chip 540 to the timing controller 200.

The timing controller 200 may include an eye-diagram compensating part 220, an image compensating part 240 and a signal generating part 260.

The eye-diagram compensating part 220 may receive the temperature signal TEMP representing the temperature of the data driving chips 540 and determine an eye-diagram compensating value CMP corresponding to the temperature of the data driving chips 540 based on the temperature signal TEMP.

In one exemplary embodiment, for example, the eye-diagram compensating part 220 may determine the eye-diagram compensating value CMP corresponding to the temperature of the data driving chips 540 based on the temperature signal TEMP using the memory 600.

The memory 600 may store the eye-diagram compensating value CMP corresponding to the temperature of the data driving chips 540. The memory 600 may store a lookup table 620 having eye-diagram compensating values (e.g., CMPA to CMPN) and the temperatures corresponding thereto (e.g., TEMPA to TEMPN).

The timing controller 200 may adjust a waveform of the data signal DATA based on the eye-diagram compensating value CMP according to the temperature of the data driving chips 540.

In one exemplary embodiment, for example, the timing controller 200 may adjust the eye-diagram waveform of the data signal DATA in a way such that the eye-diagram waveform does not meet (e.g., touch or cross) a mask MS representing a noise limit of the data signal DATA.

Figure 6:
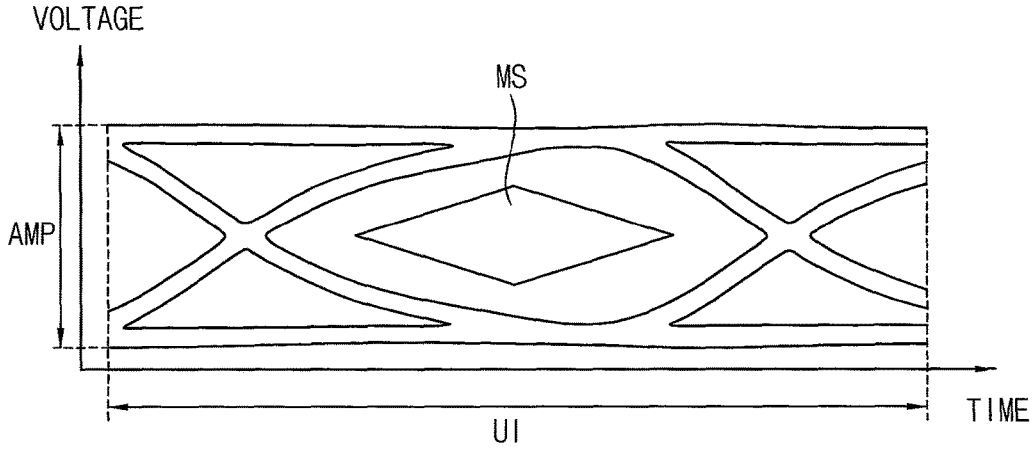
FIGS. 6 and 7 are waveform diagrams illustrating exemplary eye-diagrams of the data signal of FIG. 3.
Figure 7:
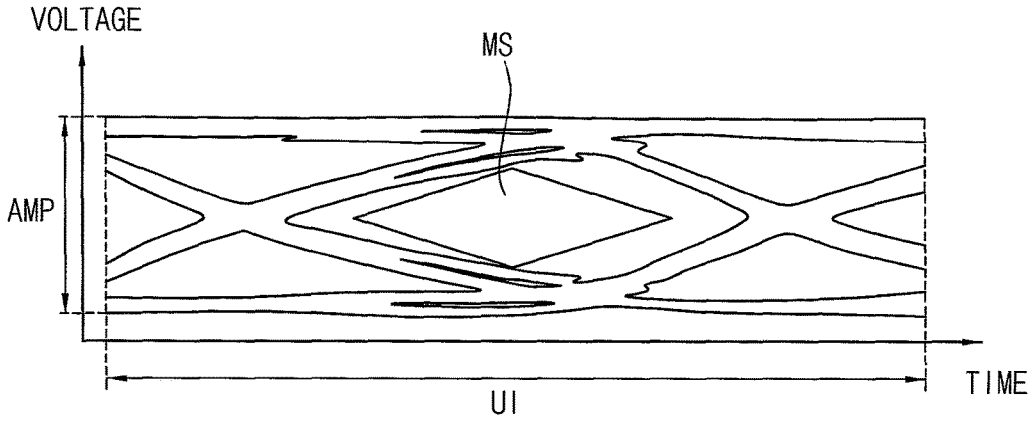

The eye-diagram waveform is generated by overlapping levels of a signal in a predetermined time duration so that the eye-diagram waveform represents the flow or rate of the level change of the signal. The eye-diagram waveform typically has a human eye-like shape (as shown in FIGS. 6 and 7) so that the overlapped waveform is called to the eye-diagram. A central portion of the eye-diagram in which the signal is not disposed vertically and horizontally is called to an eye-opening.

Generally, as the noise of the signal increases, the size of the eye-opening decreases. In contrast, as the noise of the signal decreases and an integrity of the signal increases, the size of the eye-opening increases.

A horizontal axis of the eye-diagram represents a time and a vertical axis of the eye-diagram represents a voltage. The mask MS having a rhombus or diamond shape is in the central portion of the eye-diagram. The mask MS represents the noise limit of the signal. When the eye-diagram waveform meets or crosses the mask MS, it is determined that the noise of the signal exceeds the noise limit.

The image compensating part 240 compensates the input image data IMG to generate the data signal DATA. In one exemplary embodiment, for example, the image compensating part 240 may adjust the waveform of the data signal DATA based on the eye-diagram compensating value CMP corresponding to the temperature of the data driving chips 540.

The image compensating part 240 may include an adaptive color correcting part and a dynamic capacitance compensating part.

The adaptive color correcting part receives the input image data IMG and operates an adaptive color correction ("ACC"). The adaptive color correcting part may compensate the input image data IMG using a gamma curve.

The dynamic capacitance compensating part operates a dynamic capacitance compensation ("DCC"), which compensates the grayscale data of present frame data using previous frame data and the present frame data.

In one exemplary embodiment, for example, the dynamic capacitance compensating part may determine an overshooting value to change the grayscale data of the present frame data using the previous frame data and the present frame data.

The signal generating part 260 generates the first control signal CONT1 based on the input control signal CONT. The signal generating part 260 outputs the first control signal CONT1 to the gate driver 300. The signal generating part 260 generates the second control signal CONT2 based on the input control signal CONT. The signal generating part 260 outputs the second control signal CONT2 to the data driver 500. The signal generating part 260 generates the third control signal CONT3 based on the input control signal CONT. The signal generating part 260 outputs the third control signal CONT3 to the gamma reference voltage generator 400.

FIGS. 6 and 7 are waveform diagrams illustrating exemplary eye-diagrams of the data signal DATA of FIG. 3.

FIG. 6 represents the eye-diagram waveform of the data signal DATA having a relatively small amount of noise. FIG. 7 represents the eye-diagram waveform of the data signal DATA having a relatively large amount of noise.

When the data signal DATA has the eye-diagram waveform like FIG. 6, it is less desired to compensate the data signal DATA may be low. When the data signal DATA has the eye-diagram waveform like FIG. 7, it is more desired to compensate the data signal DATA may be high.

The eye-diagram compensating value CMP may be determined according to a desired degree of compensation of the eye-diagram of the data signal DATA.

The desired degree of compensation of the eye-diagram of the data signal DATA may vary according to the temperature of the data driving chip 540. In one exemplary embodiment, for example, even though the data signal DATA is compensated to have the eye-diagram like FIG. 6 in an ordinary temperature, the data signal DATA may have the eye-diagram like FIG. 7 in a high temperature. Thus, the eye-diagram compensating value CMP may vary according to the temperature of the data driving chip 540.

Referring back to FIG. 5, when the data driving chip 540 has a first temperature TEMPA, the eye-diagram compensating value may be a first compensating value CMPA. When the data driving chip 540 has a second temperature TEMPB different from the first temperature TEMPA, the eye-diagram compensating value may be a second compensating value CMPB different from the first compensating value CMPA. When the data driving chip 540 has a third temperature TEMPC different from the first temperature TEMPA and the second temperature TEMPB, the eye-diagram compensating value may be a third compensating value CMPC different from the first compensating value CMPA and the second compensating value CMPB.

Referring to FIGS. 6 and 7, a horizontal width of the eye-diagram means a unit interval UI. The unit interval UI may be defined as a reciprocal of a frame rate of the data signal DATA. In one exemplary embodiment, for example, as the frame rate of the data signal DATA increases, the horizontal width of the eye-diagram which is the unit interval UI decreases. In contrast, as the frame rate of the data signal DATA decreases, the horizontal width of the eye-diagram which is the unit interval UI increases.

In FIGS. 6 and 7, a vertical width of the eye-diagram means an amplitude AMP. In one exemplary embodiment, for example, as the amplitude AMP of the data signal DATA increases, the vertical width of the eye-diagram increases. In contrast, as the amplitude AMP of the data signal DATA decreases, the vertical width of the eye-diagram decreases.

In FIGS. 6 and 7, an inclination of a diagonal waveform of the eye-diagram may be determined by the overshooting value of the dynamic capacitance compensating part. In one exemplary embodiment, for example, as the overshooting value of the data signal DATA generally increase, the inclination of the diagonal waveform of the eye-diagram may increase. In contrast, as the overshooting value of the data signal DATA generally decreases, the inclination of the diagonal waveform of the eye-diagram may decrease.

In an exemplary embodiment, the timing controller 200 may adjust the data signal DATA such that the eye-diagram waveform does not meet the mask MS.

In an exemplary embodiment, the timing controller 200 may increase the amplitude of the data signal DATA based on the eye-diagram compensating value CMP according to the temperature of the data driving chip 540 so that the vertical width of the eye-diagram waveform may be increased. Thus, the distance between the mask and the eye-diagram waveform may be increased.

In an exemplary embodiment, the timing controller 200 may increase the overshooting value of the data signal DATA based on the eye-diagram compensating value CMP according to the temperature of the data driving chip 540 so that the inclination of the diagonal waveform of the eye-diagram may be increased. Thus, the distance between the mask and the eye-diagram waveform may be increased.

According to an exemplary embodiment, the eye-diagram waveform of the data signal DATA is adjusted according to the temperature of the data driving chip 540 so that the noise of the data signal DATA in an ordinary temperature and a high temperature may be compensated. Thus, the display quality of the display panel 100 may be improved.

Figures 8, 9:
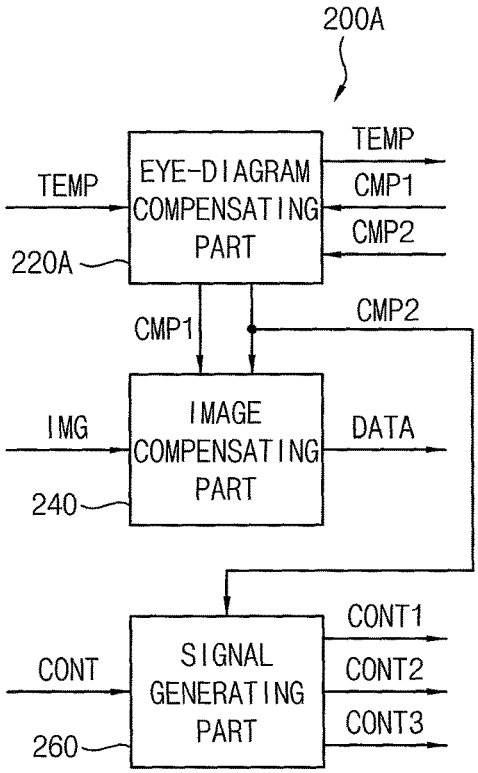
FIG. 8 is a block diagram illustrating a timing controller of a display apparatus according to an alternative exemplary embodiment of the invention.
FIG. 9 is a diagram illustrating a lookup table stored in a memory of FIG. 8.

FIG. 8 is a block diagram illustrating a timing controller of a display apparatus according to an alternative exemplary embodiment of the invention. FIG. 9 is a diagram illustrating a lookup table stored in a memory of FIG. 8.

An exemplary embodiment of the display apparatus and the method of driving the display panel including the timing controller and the lookup table shown in FIGS. 8 and 9 is substantially the same as the exemplary embodiments of the display apparatus and the method of driving the display panel described above referring to FIGS. 1 to 7 except that the horizontal axis component of the eye-diagram is further compensated. Thus, the same reference numerals will be used to refer to the same or like parts as those described in the exemplary embodiment described above referring to FIGS. 1 to 7, and any repetitive detailed descriptions thereof will be omitted or simplified.

Referring to FIGS. 1 to 3, 8 and 9, an exemplary embodiment of the display apparatus includes a display panel 100 and a display panel driver. The display panel driver includes a timing controller 200A, a gate driver 300, a gamma reference voltage generator 400 and a data driver 500.

The timing controller 200A receives input image data IMG and an input control signal CONT from an external apparatus (not shown). The input image data may include red image data, green image data and blue image data. The input control signal CONT may include a master clock signal and a data enable signal. The input control signal CONT may further include a vertical synchronizing signal and a horizontal synchronizing signal.

The timing controller 200A generates a first control signal CONT1, a second control signal CONT2, a third control signal CONT3 and a data signal DATA based on the input image data IMG and the input control signal CONT.

The timing controller 200A generates the first control signal CONT1 for controlling an operation of the gate driver 300 based on the input control signal CONT, and outputs the first control signal CONT1 to the gate driver 300. The first control signal CONT1 may further include a vertical start signal and a gate clock signal.

The timing controller 200A generates the second control signal CONT2 for controlling an operation of the data driver 500 based on the input control signal CONT, and outputs the second control signal CONT2 to the data driver 500. The second control signal CONT2 may include a horizontal start signal and a load signal.

The timing controller 200A generates the data signal DATA based on the input image data IMG The timing controller 200A outputs the data signal DATA to the data driver 500.

The timing controller 200A generates the third control signal CONT3 for controlling an operation of the gamma reference voltage generator 400 based on the input control signal CONT, and outputs the third control signal CONT3 to the gamma reference voltage generator 400.

The timing controller 200A adjusts waveforms of the data signals to be outputted to the data driving chips according to temperatures of the data driving chips.

The data driver 500 receives the second control signal CONT2 and the data signal DATA from the timing controller 200A, and receives the gamma reference voltages VGREF from the gamma reference voltage generator 400. The data driver 500 converts the data signal DATA into data voltages of analog type using the gamma reference voltages VGREF. The data driver 500 outputs the data voltages to the data lines DL.

The display apparatus may further include a memory 600 independently formed from (or disposed outside of) the timing controller 200A. In one exemplary embodiment, for example, the memory 600 may be an EEPROM. The memory 600 may be in the form of an IC.

The data driving chip 540 may include a temperature sensor 542 which senses a temperature of the data driving chip 540. The data driver 500 may be provided in plural, and the temperature sensor 542 may be disposed in or adjacent to each of a plurality of data driving chips 540. In such an embodiment, the temperature sensor 524 is provided in plural, and the data drivers 500 may include a plurality of temperature sensors 542, respectively.

The temperature sensor 542 output a temperature signal TEMP representing the temperature of the data driving chip 540 to the timing controller 200A.

The timing controller 200A may include an eye-diagram compensating part 220A, an image compensating part 240 and a signal generating part 260.

The eye-diagram compensating part 220A may receive the temperature signal TEMP and determine eye-diagram compensating values CMP1 and CMP2 corresponding to the temperature of the data driving chips 540 based on the temperature signal TEMP.

In an exemplary embodiment, the eye-diagram compensating values CMP1 and CMP2 have an eye-diagram level compensating value CMP1 to adjust a voltage level of the data signal DATA and an eye-diagram timing compensating value CMP2 to adjust a frame rate of the data signal DATA.

In one exemplary embodiment, for example, the eye-diagram compensating part 220A may determine the eye-diagram compensating values CMP1 and CMP2 corresponding to the temperature of the data driving chips 540 based on the temperature signal TEMP using the memory 600.

The memory 600 may store the eye-diagram compensating values CMP1 and CMP2 corresponding to the temperature of the data driving chips 540. The memory 600 may store a lookup table 620A having the eye-diagram compensating values CMP1 and CMP2 corresponding to the temperature signal TEMP.

The timing controller 200A may adjust a waveform of the data signal DATA based on the eye-diagram compensating values CMP1 and CMP2 according to the temperature of the data driving chips 540.

In one exemplary embodiment, for example, the timing controller 200A may adjust the eye-diagram waveform of the data signal DATA such that the eye-diagram waveform does not meet a mask MS representing a noise limit of the data signal DATA.

The image compensating part 240 compensates the input image data IMG to generate the data signal DATA. In one exemplary embodiment, for example, the image compensating part 240 may adjust the waveform of the data signal DATA based on an eye-diagram level compensating value CMP1 corresponding to the temperature of the data driving chips 540. In one exemplary embodiment, for example, the image compensating part 240 may adjust the waveform of the data signal DATA based on the eye-diagram level compensating value CMP1 corresponding to the temperature of the data driving chips 540 and an eye-diagram timing compensating value CMP2 corresponding to the temperature of the data driving chips 540.

The image compensating part 240 may include an adaptive color correcting part and a dynamic capacitance compensating part.

In one exemplary embodiment, for example, the dynamic capacitance compensating part may determine an overshooting value to change the grayscale data of the present frame data using the previous frame data and the present frame data.

The signal generating part 260 generates the first control signal CONT1 based on the input control signal CONT and the eye-diagram timing compensating value CMP2 corresponding to the temperature of the data driving chips 540. The signal generating part 260 outputs the first control signal CONT1 to the gate driver 300. The signal generating part 260 generates the second control signal CONT2 based on the input control signal CONT and the eye-diagram timing compensating value CMP2 corresponding to the temperature of the data driving chips 540. The signal generating part 260 outputs the second control signal CONT2 to the data driver 500. The signal generating part 260 generates the third control signal CONT3 based on the input control signal CONT and the eye-diagram timing compensating value CMP2 corresponding to the temperature of the data driving chips 540. The signal generating part 260 outputs the third control signal CONT3 to the gamma reference voltage generator 400.

In such an embodiment, a desired degree of compensation of the eye-diagram of the data signal DATA may vary according to the temperature of the data driving chip 540. Thus, the eye-diagram compensating values CMP1 and CMP2 may vary according to the temperature of the data driving chip 540.

Referring back to FIG. 9, when the data driving chip 540 has a first temperature TEMPA, the eye-diagram level compensating value CMP1 may be a first level compensating value CMP1A and the eye-diagram timing compensating value CMP2 may be a first timing compensating value CMP2A. When the data driving chip 540 has a second temperature TEMPB, the eye-diagram level compensating value CMP1 may be a second level compensating value CMP1B different from the first level compensating value CMP1A and the eye-diagram timing compensating value CMP2 may be a second timing compensating value CMP2B different from the first timing compensating value CMP2A. When the data driving chip 540 has a third temperature TEMPC, the eye-diagram level compensating value CMP1 may be a third level compensating value CMP1C different from the first level compensating value CMP1A and the second level compensating value CMP1B and the eye-diagram timing compensating value CMP2 may be a third timing compensating value CMP2C different from the first timing compensating value CMP2A and the second timing compensating value CMP2B.

In such an embodiment, the timing controller 200A may adjust the data signal DATA such that the eye-diagram waveform does not meet the mask MS.

In an exemplary embodiment, the timing controller 200A may increase the amplitude of the data signal DATA based on the eye-diagram level compensating value CMP1 according to the temperature so that the vertical width of the eye-diagram waveform may be increased. Thus, the distance between the mask and the eye-diagram waveform may be increased.

In an exemplary embodiment, the timing controller 200A may increase the overshooting value of the data signal DATA based on the eye-diagram level compensating value CMP1 according to the temperature so that the inclination of the diagonal waveform of the eye-diagram may be increased. Thus, the distance between the mask and the eye-diagram waveform may be increased.

In an exemplary embodiment, the timing controller 200A may decrease the frame rate of the data signal DATA based on the eye-diagram timing compensating value CMP2 according to the temperature so that the horizontal width of the eye-diagram waveform may be increased. Thus, the distance between the mask and the eye-diagram waveform may be increased.

According to an exemplary embodiment, the eye-diagram waveform of the data signal DATA is adjusted according to the temperature of the data driving chip 540 so that the noise of the data signal DATA in an ordinary temperature and a high temperature may be compensated. Thus, the display quality of the display panel 100 may be improved.

According to exemplary embodiments of the display apparatus and the method of driving the display panel, the waveform of the data signal is adjusted according to the temperature of the data driving chip so that the display quality of the display panel may be improved.

The foregoing is illustrative of the invention and is not to be construed as limiting thereof. Although a few exemplary embodiments of the invention have been described, those skilled in the art will readily appreciate that many modifications are possible in the exemplary embodiments without materially departing from the novel teachings and advantages of the invention. Accordingly, all such modifications are intended to be included within the scope of the invention as defined in the claims. In the claims, means-plus-function clauses are intended to cover the structures described herein as performing the recited function and not only structural equivalents but also equivalent structures. Therefore, it is to be understood that the foregoing is illustrative of the invention and is not to be construed as limited to the specific exemplary embodiments disclosed, and that modifications to the disclosed exemplary embodiments, as well as other exemplary embodiments, are intended to be included within the scope of the appended claims. The invention is defined by the following claims, with equivalents of the claims to be included therein.

What is claimed is:

1. A display apparatus comprising:

a display panel which displays an image;

a gate driver which outputs a gate signal to the display panel;

a data driver comprising a plurality of data driving chips which outputs data voltages to the display panel based on data signals; and a timing controller which adjusts a waveform of the data signals based on a temperature of the data driving chips received from a temperature sensor disposed in each of the data driving chips, wherein the timing controller comprises:

an eye-diagram compensating part which receives a temperature signal representing the temperature of the data driving chips from the temperature sensor and determines an eye-diagram compensating value corresponding to the temperature of the data driving chips based on the temperature signal; and an image compensating part which adjusts an eye-diagram waveform of the data signals based on the eye-diagram compensating value received from a look-up-table in memory.

2. The display apparatus of claim 1, wherein the timing controller adjusts the eye-diagram waveform of the data signals in a way such that the eye-diagram waveform of the data signals does not meet a mask representing a noise limit of the data signal.

3. The display apparatus of claim 1, wherein the memory stores the eye-diagram compensating value corresponding to the temperature of the data driving chips, wherein the memory is disposed outside of the timing controller.

4. The display apparatus of claim 1, wherein the timing controller increases an amplitude of the data signals based on the eye-diagram compensating value in response to the temperature signal so that a vertical width of the eye-diagram waveform is increased.

5. The display apparatus of claim 1, wherein the image compensating part of the timing controller determines an overshooting value to change grayscale data of a present frame data signal using a previous frame data signal and the present frame data signal.

6. The display apparatus of claim 5, wherein the timing controller increases the overshooting value of the data signals based on the eye-diagram compensating value corresponding to the temperature of the data driving chips so that an inclination of a diagonal waveform of the eye-diagram waveform is increased.

7. The display apparatus of claim 1, wherein the timing controller further comprises a signal generating part which generates a first control signal to control a driving timing of the gate driver based on an input control signal, and a second control signal to control a driving timing of the data driver based on the input control signal.

8. The display apparatus of claim 7, wherein the timing controller decreases a frame rate of the data signals based on the eye-diagram compensating value corresponding to the temperature of the data driving chips so that a horizontal width of the eye-diagram waveform is increased.

9. The display apparatus of claim 8, wherein the eye-diagram compensating part determines an eye-diagram level compensating value corresponding to the temperature of the data driving chips and an eye-diagram timing compensating value corresponding to the temperature of the data driving chips, based on the temperature signal, the eye-diagram level compensating value determines at least one of an amplitude of the data signals and an overshooting value of the data signals, the eye-diagram timing compensating value determines the frame rate of the data signals, the image compensating part compensates the data signals based on input image data, the eye-diagram level compensating value and the eye-diagram timing compensating value, and the signal generating part generates the first control signal and the second control signal based on the input control signal, the eye-diagram level compensating value and the eye-diagram timing compensating value.

10. A method of driving a display panel of a display apparatus, the method comprising:

adjusting a waveform of data signals to be outputted from data driving chips of the display apparatus based on a temperature of the data driving chips, received from a temperature sensor disposed in each of the data driving chips, using a timing controller of the display apparatus;

outputting data voltages to the display panel based on the data signals outputted from the data driving chips;

outputting gate signals to the display panel; and displaying an image using the display panel based on the gate signals and the data voltages, wherein the timing controller comprises:

an eye-diagram compensating part which receives a temperature signal from the temperature sensor representing the temperature of the data driving chips and determines an eye-diagram compensating value corresponding to the temperature of the data driving chips based on the temperature signal; and an image compensating part which adjusts an eye-diagram waveform of the data signals based on the eye-diagram compensating value received from a look-up-table in memory.

11. The method of claim 10, wherein the adjusting the waveform of the data signals comprises adjusting the eye-diagram waveform of the data signals in a way such that the eye-diagram waveform does not meet a mask representing a noise limit of the data signal.

12. The method of claim 10, wherein the adjusting the waveform of the data signals comprises increasing an amplitude of the data signals based on the eye-diagram compensating value corresponding to the temperature of the data driving chips so that a vertical width of the eye-diagram waveform is increased.

13. The method of claim 10, wherein the image compensating part of the timing controller determines an overshooting value to change grayscale data of present frame data signal using previous frame data signal and the present frame data signal.

14. The method of claim 13, wherein the adjusting the waveform of the data signals comprises increasing the overshooting value of the data signals based on the eye-diagram compensating value corresponding to the temperature of the data driving chips so that an inclination of a diagonal waveform of the eye-diagram waveform is increased.

15. The method of claim 10, wherein the timing controller further comprises a signal generating part which generates a first control signal to control a driving timing of the gate driver based on an input control signal, and a second control signal to control a driving timing of the data driver based on the input control signal.

16. The method of claim 15, wherein the adjusting the waveform of the data signals comprises decreasing a frame rate of the data signals based on the eye-diagram compensating value corresponding to the temperature of the data driving chips so that a horizontal width of the eye-diagram waveform is increased.

17. The method of claim 16, wherein the eye-diagram compensating part determines an eye-diagram level compensating value and an eye-diagram timing compensating value corresponding to the temperature of the data driving chips based on the temperature signal, the eye-diagram level compensating value determines at least one of an amplitude of the data signals and an overshooting value of the data signals, the eye-diagram timing compensating value determines the frame rate of the data signals, the image compensating part compensates the data signals based on input image data, the eye-diagram level compensating value and the eye-diagram timing compensating value, and the signal generating part generates the first control signal and the second control signal based on the input control signal, the eye-diagram level compensating value and the eye-diagram timing compensating value.

* * * * *